US005878669A

United States Patent [19]

Becker et al.

[11] Patent Number: 5,878,669

[45] Date of Patent: Mar. 9, 1999

[54] CLEANING DEVICE PROVIDED ON A ROTARY PRINTING MACHINE

[75] Inventors: Willi Becker, Bammental; Jens Friedrichs, Heidelberg; Frank Kropp, Neckarsteinach, all of Germany

[73] Assignee: Heidelberger Druckmaschinen AG, Heidelberg, Germany

[21] Appl. No.: 822,250

[22] Filed: Mar. 20, 1997

[30] Foreign Application Priority Data

Mar. 21, 1996 [DE] Germany ..... 196 11 125.0

[51] Int. Cl.[6] ..... B41F 35/00

[52] U.S. Cl. ..... 101/425; 101/423

[58] Field of Search ..... 101/425, 423, 101/424; 15/256.5, 256.51, 256.52

[56] References Cited

U.S. PATENT DOCUMENTS

| | | | |
|---|---|---|---|
| 2,585,617 | 2/1952 | Battey | 101/156 |
| 4,270,450 | 6/1981 | Difflipp et al. | 101/425 |
| 4,922,821 | 5/1990 | Nozaka et al. | 101/425 |
| 4,991,507 | 2/1991 | Nozaka et al. | 101/425 |
| 5,271,326 | 12/1993 | Ebina | 101/425 |
| 5,317,969 | 6/1994 | Tateishi | 101/425 |

FOREIGN PATENT DOCUMENTS 0257818 3/1988 European Pat. Off. .

*Primary Examiner*—Edgar S. Burr
*Assistant Examiner*—Anthony H. Nguyen
*Attorney, Agent, or Firm*—Nils H. Ljungman and Associates

[57] ABSTRACT

A cleaning device provided on a rotary printing machine for cleaning the outer cylindrical surfaces of cylinders includes a pressing-on bar for pressing a cleaning cloth on a respective outer cylindrical surface, adjusting elements for engaging the pressing-on bar, and an elastic profile rail to guide and press a cleaning cloth onto an outer cylindrical surface over the entire cylinder width. The elastic profile rail receives a plurality of forces from spring elements. The elastic profile rail and the spring elements allow a uniform cleaning of the outer cylindrical surface despite the presence of uneven or rough portions of the outer cylindrical surface that might be encountered by the cleaning device during cleaning.

12 Claims, 3 Drawing Sheets

CLEANING DEVICE PROVIDED ON A ROTARY PRINTING MACHINE

CROSS REFERENCE TO RELATED APPLICATION

This application is a related application to copending U.S. patent application Ser. No. 08/755,467, filed on Nov. 11, 1996, which claims priority from Federal Republic of Germany Patent Application No. DE 195 43 518.4, filed on Nov. 11, 1995.

BACKGROUND OF THE INVENTION

1. Field of the Invention

The present invention relates generally to a cleaning device provided on a rotary printing machine for cleaning the outer cylindrical surfaces of cylinders. The cleaning device can include a pressing-on bar for pressing a cleaning cloth on a respective outer cylindrical surface, adjusting elements for engaging the pressing-on bar and an elastic profile rail, via which elastic profile rail the cleaning cloth can be guided and pressed on the outer cylindrical surface over the entire cylinder width.

2. Background Information

A known cleaning device is disclosed in European Patent No. 0 257 818 B1, wherein the cleaning device is lifted, via a cam device, against the pressure of the contact cylinder. Given a rather high cleaning velocity, the cam follower causes great impacts when coming into contact with the cam. A further disadvantage is the fact that the entire device, together with the cloth rolls, has to be moved so that considerable forces are required to overcome the inertia. The resulting oscillations may affect the cleaning quality over the cylinder length.

OBJECT OF THE INVENTION

Proceeding from the state of the art, it is the object of the present invention to achieve a uniform and good cleaning result of the outer cylindrical surface over the entire length.

SUMMARY OF THE INVENTION

According to the present invention, this object can be achieved in that adjusting elements can be designed as pneumatic cylinders. The contact pressure on the profile rail can be effected via spring elements being supported on the pressing-on rail. A spring rail can be provided between the spring elements and the profile rail to ensure a relatively uniform force transmission. Owing to this solution, the profile rail may be brought in contact with the outer cylindrical surface in a substantially oscillation-free manner, and uneveness of the outer cylindrical surface can essentially be compensated for. Furthermore, the spring rail can provide a relatively uniform contact pressure of the profile rail so that, seen over the entire cylinder length, a relatively optimal cleaning result can be achieved.

An advantageous embodiment of the present invention can include spring elements that are preferably designed as compression springs with spring bolts. The spring elements can be adjustable via adjusting nuts. This embodiment can provide a relatively uniform contact pressure over the entire cylinder length.

In a further advantageous embodiment of the present invention, the spring rail can be fastened to the spring bolts. The spring rail can preferably be designed as a steel band, and the profile rail can preferably be mounted on the steel band so as to be exchangeable or, in other words, replaceable. In this embodiment, the steel band can substantially stabilize the profile rail, which profile rail may be made, in a possible embodiment, of a rubber-like material, or in other words, an elastomer or elastomeric material. Moreover, the profile rail can transfer the contact forces substantially uniformly, and can make it also possible to exchange the profile rail essentially without problems.

In other words, for a possible embodiment of the present invention, the profile rail can be realized as a relatively flexible member. The profile rail can extend along substantially the entire length of the cylinder to press a cleaning cloth against the outer cylindrical surface of the cylinder.

Because the profile rail can be a relatively flexible member, localized forces can be preferably redistributed along the profile rail by deformation of the profile rail. If the cleaning cloth were to encounter a localized outwardly projecting portion of the outer cylindrical surface of a cylinder (that is, a "bump") that extended only a relatively small distance along the length of the cylinder, a portion of the profile rail in the vicinity of the bump can deform to substantially conform to the bump. Therefore, a substantial portion of the cleaning cloth can remain in contact with the outer cylindrical surface of a cylinder when the bump is encountered by the cleaning device. In essence, the profile rail can absorb the impact, force, or shock of the bump and can substantially prevent an oscillation of the entire profile rail away from and then towards the outer cylindrical surface of the cylinder in response to the bump.

In contrast, if the profile rail were substantially rigid, the entire profile rail could essentially be uniformly displaced radially outward from the cylinder surface. Upon encountering the bump, the localized impact or force at the bump can be transferred to the profile rail to displace the entire profile rail essentially as a rigid unit uniformly away from the outer cylindrical surface of the cylinder. The remainder of the cleaning cloth away from the bump could therefore momentarily lose contact with the outer surface of the cylinder and be unable to clean the cylinder, leaving a region uncleaned and deteriorating the cleaning performance of the cleaning device. Following the bump, the entire profile rail could be displaced radially inward to strike or impact the outer surface of the cylinder to complete an oscillation away from and then towards the cylinder caused by the bump.

Similarly, if the relatively flexible profile rail were to encounter a localized depression on the outer cylindrical surface of a cylinder, the portion of the profile rail in the vicinity of the depression could deform into the depression as a result of the applied contact pressure to permit cleaning of the depression. In contrast, if the profile rail were relatively rigid, the profile rail could essentially span the localized depression and prevent the cleaning cloth from cleaning the surface of the depression.

In another possible embodiment of the present invention, the spring rail can be realized as a steel band. The steel band can be relatively flexible and can deform in response to bumpy or uneven portions of the outer cylindrical surface of the cylinder, similar in manner to the flexible profile rail.

In yet another possible embodiment of the present invention, the spring rail can be realized as a steel strap fastened to the spring bolts. The spring rail can then substantially uniformly transfer the localized force applied by each spring bolt to the profile rail to relatively uniformly press the cleaning cloth against the outer cylindrical surface of the cylinder.

In a further possible embodiment of the present invention, the spring rail can be realized as a steel strap fastened to the spring bolts and the profile rail can be made of an elastomer, or in other words, an elastomeric or rubber-like material. The resiliency or flexibility of the spring rail and profile rail can substantially uniformly press the cleaning cloth against the outer cylindrical surface of the cylinder, and can substantially absorb impact or can deform in response to an uneven or rough portion of the outer cylindrical surface to substantially eliminate oscillation and to substantially maintain contact of the cleaning cloth with the outer cylindrical surface of the cylinder.

In yet a further possible embodiment of the present invention, the profile rail can be removably mounted on the spring rail to allow replacement or exchange of a worn profile rail with a new profile rail during routine maintenance of the cleaning device.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Specimen embodiments of the present invention are schematically illustrated in the drawings, wherein.

DESCRIPTION OF THE PREFERRED EMBODIMENT

Figure 1:
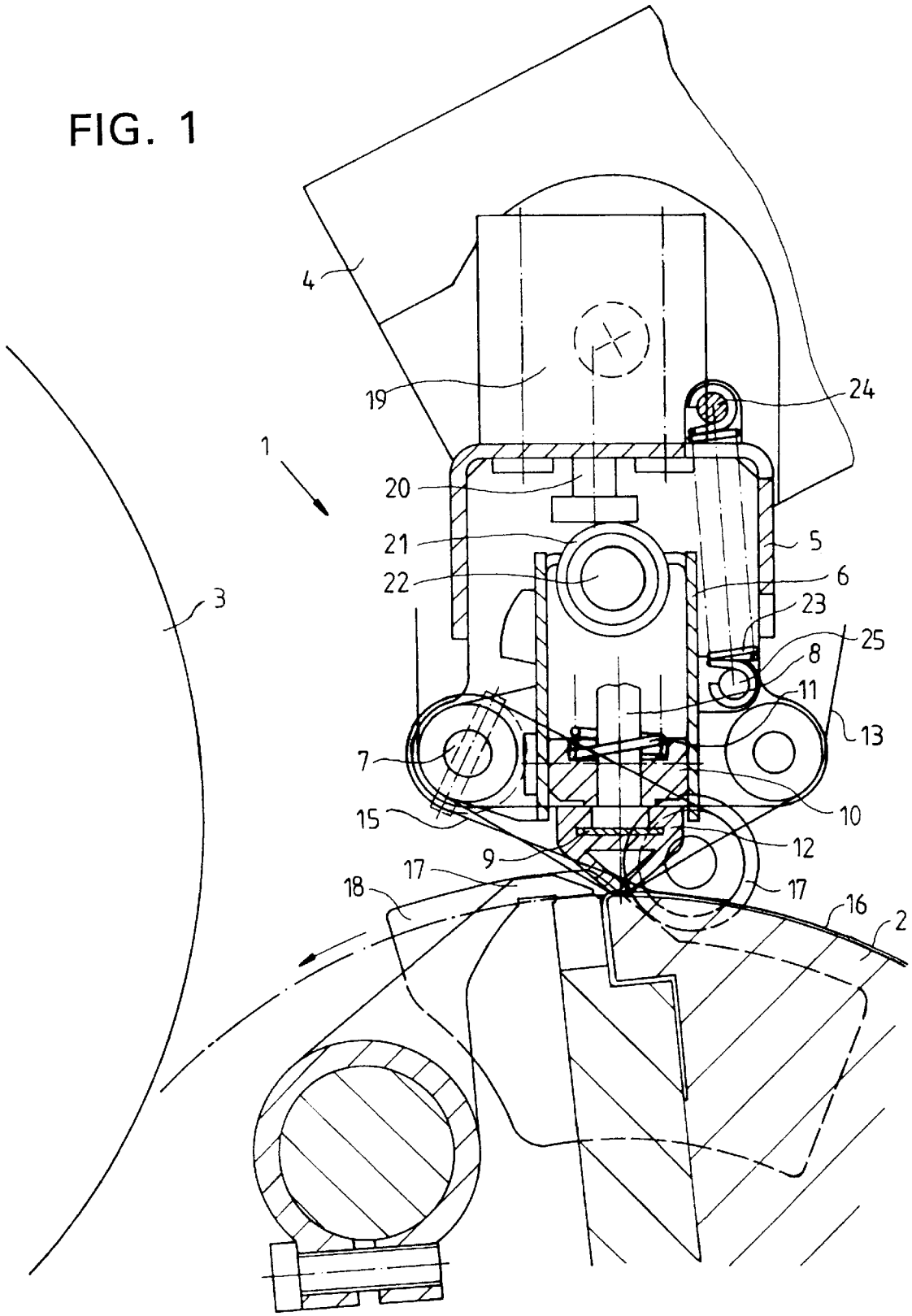
FIG. 1 is a partial cross-sectional view of the cleaning device with the cleaning cloth being in contact with the outer cylindrical surface.

A cleaning device 1 can be engaged at an impression cylinder 2 or, by pivoting the cleaning device 1 in a support 4, at a blanket cylinder 3. The support 4 can be provided between the machine side frames (not shown) on both sides of the cleaning device 1, so that the cleaning device 1 may be removed.

A pressing-on bar 6, the pressing-on bar 6 preferably extending over the length of the cylinder 2 or cylinder 3, can be provided in a supporting frame 5. The supporting frame 5 can preferably be pivot-mounted between the supports 4. Via pivots 7, the pressing-on bar 6 can be pivot-mounted, on both sides thereof, on the supporting frame 5. Seen over its entire length, the pressing-on bar 6 can accomodate a plurality of spring bolts 8 guided in guiding bodies 10. Compression springs 11 can act on the guiding bodies 10, so that the profile rail 12 can be resiliently supported by the guiding bodies 10.

Figure 2:
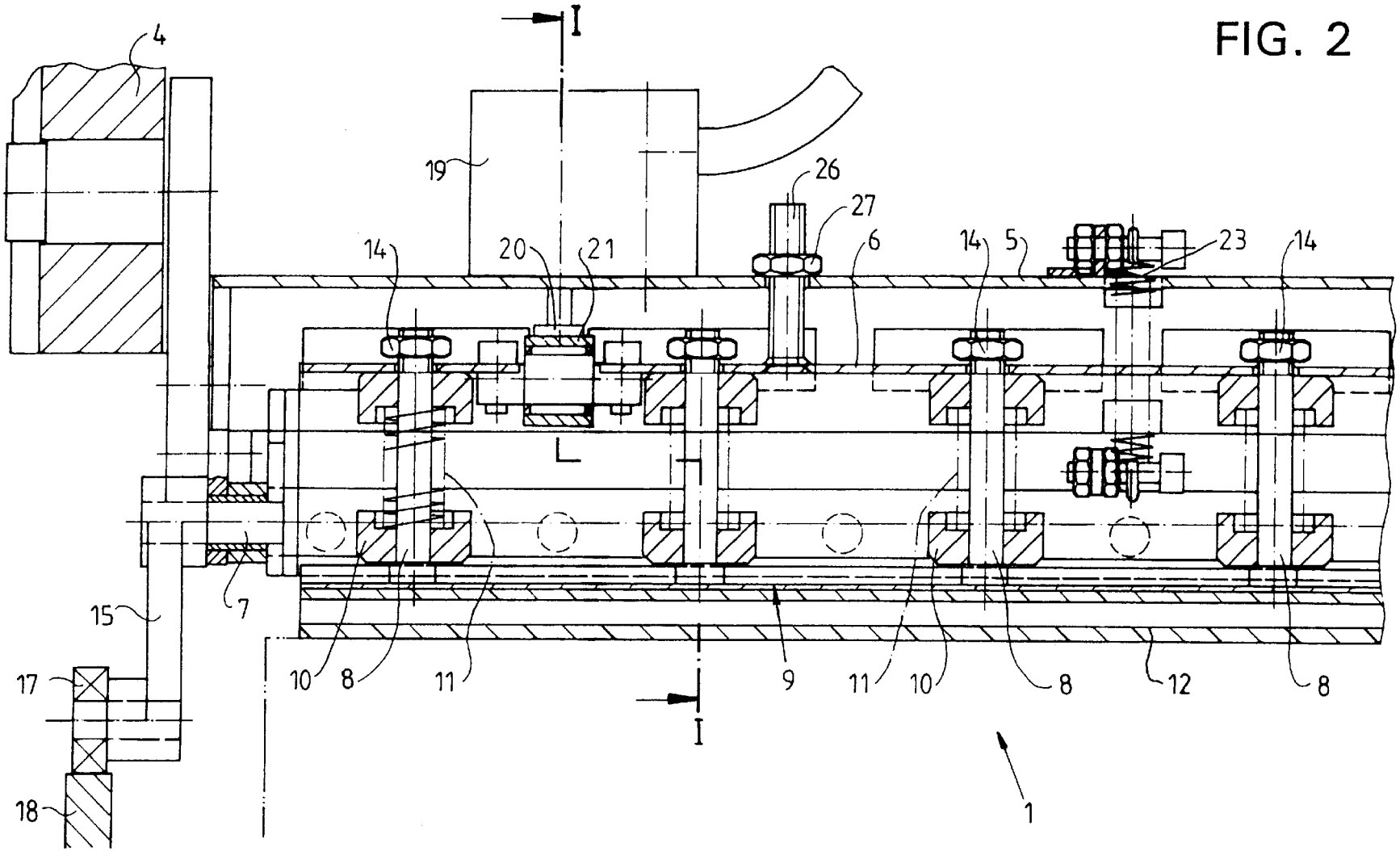
FIG. 2 is a partial sectional view of the cleaning device, seen in longitudinal direction.

The pressing-on bar 6 can guide a cleaning cloth 13. Nuts 14 can be provided on the spring bolts 8 to permit an adjustment of the spring deflection and, when in contact with the pressing-on bar 6, can limit the spring deflection (FIG. 2). With the profile rail 12 being engaged at an outer cylindrical surface of cylinder 2 or cylinder 3, (as shown in FIG. 1, the profile rail 12 is engaged at an outer cylindrical surface 16 of cylinder 2) the nuts 14 are preferably somewhat lifted off the pressing-on rail 6.

Pivoting levers 15 can be fastened to the pivot 7 of the pressing-on bar 6 on both sides thereof. The profile rail 12 can be engageable at the outer cylindrical surface 16 of cylinder 2 via the pivoting levers 15. The pivoting levers 15 can include cam rollers or cam followers or cam rolls 17 cooperating with cams or cam segments 18.

Pneumatic cylinders 19 can be fastened to the supporting frame 5 (one of which pneumatic cylinders 19 are shown in FIG. 2). Piston rods 20 of the pneumatic cylinders 19, preferably when the pneumatic cylinders 19 are being supplied with a pressure medium, can pivot the pressing-on bar 6 about pivot 7 downwards via rolls 21. Via journals 22, the rolls 21 can be fastened to the pressing-on bar 6. If the overpressures in the pneumatic cylinders 19 are switched off, the pressing-on bar 6 can be lifted off by tension springs 23, so that the profile rail 12 with the cleaning cloth 13 can be lifted off the outer cylindrical surface 16. The tension springs 23 can be located between pins 24 and pins 25. The pins 24 can preferably be provided on the supporting frame 5, and the pins 25 can preferably be provided on the pressing-on bar 6.

Threaded bolts 26, preferably carrying adjusting nuts 27, can be provided on the pressing-on bar 6 to limit the engaging movement of the pressing-on bar 6 via piston rod 20. In the position shown in FIG. 1, the adjusting nuts 27 can rest on the supporting frame 5 (see FIG. 2) and thus preferably limit the pivoting movement of the pressing-on bar 6 towards the outer cylindrical surface 16 of cylinder 2.

In the lower area of the spring bolts 8, a spring bar 9 can be fastened to the spring bolts 8. The spring bar 9 can extend over the length of the profile rail 12, and thus the spring bar 9 can extend over the length of the outer cylindrical surface 16. The spring bar 9 may, for a possible embodiment, be designed as a steel band and may be simultaneously used as a bearing for the profile rail 12. In the embodiment shown, the profile rail 12 can be slipped onto the spring bar 9, seen in longitudinal direction, so that the profile rail 12 can be relatively easily exchanged.

In another possible embodiment of the present invention, the spring bar 9 can be designed as or made of a steel band, and the spring bar 9 may be simultaneously used as a bearing for the profile rail 12. The profile rail 12 can be made of an elastomer or elastomeric or rubber-like material.

In other words, for a possible embodiment, the profile rail 12 can be mounted on the spring bar 9. The spring bar 9 can be preferably realized as a steel band having a relatively thin cross-section. The spring bar 9 can therefore be relatively flexible in response to forces directed substantially through the thickness of the spring bar 9, and can flex or deform in response thereto. The spring bar 9 can be fastened to the spring bolts 8 and can be mounted to transfer the forces from the spring bolts 8 to the profile rail 12 to press the cleaning cloth 13 against the outer cylindrical surface 16. Because of the flexibility of the spring bar 9, a relatively uniform force can be applied along the profile rail 12, to relatively uniformly press the cleaning cloth 13 against the outer cylindrical surface 16, from the individual force of each spring bolt 8 transferred by the spring bar 9. The spring bar 9 can deform to substantially conform with rough or uneven portions encountered on the outer cylindrical surface 16 while cleaning.

In another possible embodiment of the present invention, a profile rail 112 (see FIG. 3) can be formed from a rubber-like or elastomeric material or elastomer. The profile rail 112 can correspond to the profile rail 12 shown in FIG. 1; other items in FIG. 3 corresponding to items in FIG. 1 have the same reference number as those in FIG. 1. The profile rail 112 can thereby relatively easily deform in response to an uneven or rough portion 116 of the outer cylindrical surface 16 encountered by the cleaning device 1 while cleaning. The uneven or rough surface 116 can extend along a portion of the circumference and/or a portion of the length of the cylinder 2. The elasticity or resiliency of the profile rail 112 can permit the portion of the profile rail 112 in the vicinity of the uneven or rough portion 116 to deform and comply with the shape of the uneven or rough portion 116, allowing the remainder of the profile rail 112 to remain in operative contact with the outer cylindrical surface 16 and maintain contact of the cleaning cloth 13 for cleaning.

If a portion of the uneven or rough portion 116 of the outer cylindrical surface 16 extended outwardly away from the outer cylindrical surface 16, the localized deformation of the profile rail 112 can prevent the remainder of the profile rail 112 from lifting away from the outer cylindrical surface 16, reducing oscillations of the cleaning device 1 and allowing cleaning of the outer cylindrical surface 16 despite the uneven or rough portion. If a portion of the uneven or rough portion 116 of the outer cylindrical surface 16 were a depression on the outer cylindrical surface 16, the profile rail 112 can deform, in response to the forces applied by the spring bolts 8, in the vicinity of the depression 116 to permit continued contact of the cleaning cloth 13 with the depression 116 formed on the outer cylindrical surface 16.

Figure 3:
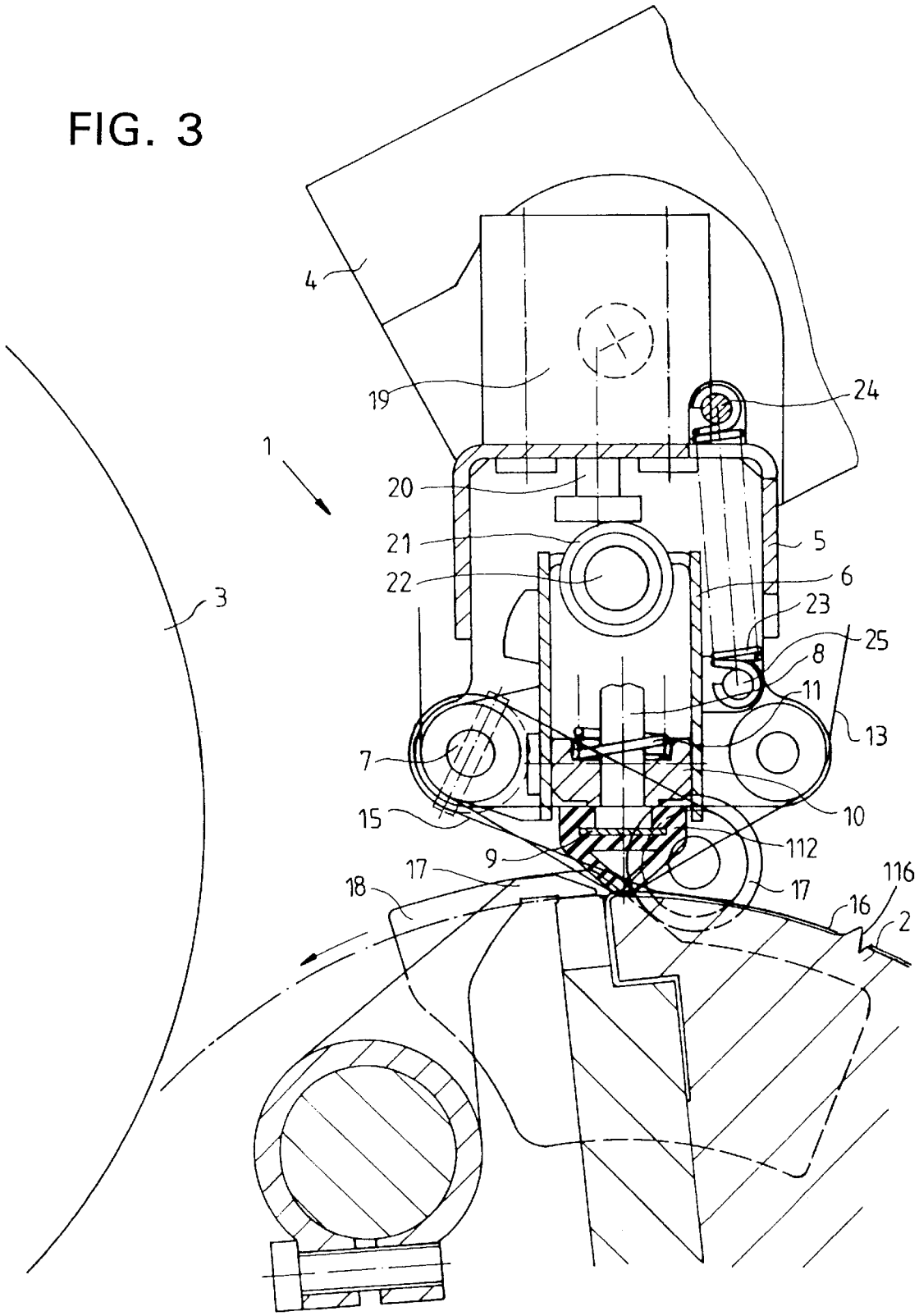
FIG. 3 is a partial cross-sectional view of another possible embodiment of the cleaning device with the cleaning cloth being in contact with the outer cylindrical surface.

In another possible embodiment of the present invention, the elastomeric profile rail 112 can be combined with a spring bar 9 realized as a steel strap (FIG. 3). The flexibility of the spring bar 9 can allow the spring bar 9 to deform with the profile rail 112 in response to uneven portions 116 encountered on the outer cylindrical surface 16, to reduce oscillations and improve the ability of the cleaning cloth 13 to remain in contact with the outer cylindrical surface 16 despite the presence of the uneven or rough portions 116.

In another possible embodiment of the present invention, the profile rail 112 can be configured to slip on and slip off the spring bar 9. This can permit the relatively easy replacement or exchange of the profile rail 112 with wear, as the old profile rail 112 can be slipped off the spring bar 9 and the new profile rail 112 can be slipped onto the spring bar 9 for maintenance.

One feature of the invention resides broadly in the cleaning device provided on a rotary printing machine for cleaning outer cylindrical surfaces of cylinders, said cleaning device comprising a pressing-on bar for pressing a cleaning cloth on a respective outer cylindrical surface, adjusting elements for engaging the pressing-on bar, and an elastic profile rail guiding the cleaning cloth and pressing it on the outer cylindrical surface over the entire cylinder width, characterized in that pneumatic cylinders 19 are provided as adjusting elements, that, via spring elements 8, 11, the contact pressure is exerted on profile rail 12, said spring elements being supported on pressing-on bar 6, and that between said spring elements 8, 11 and said profile rail 12 a spring bar 9 is provided in view of a uniform force transmission.

Another feature of the invention resides broadly in the cleaning device characterized in that the spring elements are designed as compression springs 11 and may be adjusted via adjusting nuts 14.

Yet another feature of the invention resides broadly in the cleaning device characterized in that the spring bar 9 is fastened to spring bolts 8 and designed as a steel band, and that the profile rail 12 is mounted on said steel band 9 so as to be exchangeable.

Possible elastomers or rubber-like materials which could possibly be utilized in the context of the present invention can include natural rubber, butadiene-styrene copolymer, butadiene-acrylonitrile copolymer, chlorinated-butadiene polymerisate, isobutylene-isoprene copolymer, chlorosulfonated polyethylene, polycondensates of dialkylsiloxanes, alkylpolysulfide, polyacrylate, polyurethane, copolymer of chlorotriethylene and vinylidene flouride, vinylidene flouride-hexafluoropropylene copolymer, polytetrafluoroethylene, ethylene-propylene, and fluro-silicone rubber.

Other possible elastomers or rubber-like materials which could possibly be utilized in the context of the present invention could be disclosed by the following U.S. Pat. Nos. 5,473,017, 5,472,782, 5,458,935, 5,451,640, 5,451,439, 5,436,295, 5,436,290, 5,416,146, 5,410,009, 5,397,832, 5,385,775, 5,169,706, 5,116,662, 5,114,781 and 4,981,747.

Example devices for cleaning cylinder surfaces in printing presses or rotary printing machines which could be adapted for use in the context of the present invention, and which example devices illustrate other components that can possibly be used in conjunction with the present invention, can be disclosed by the following U.S. Patents, each assigned to the assignee of the present invention: U.S. Pat. Nos. 5,174,209, 5,375,522, 5,365,849 and 5,452,660.

Additional example devices for cleaning cylinder surfaces in printing presses which could be adapted for use in the context of the present invention, and which example devices illustrate other components that can possibly be used in conjunction with the present invention can be disclosed by the following U.S. Patent Applications, each assigned to the assignee of the present invention: Ser. No. 08/515,793, Ser. No. 08/784,402, Ser. No. 08,801,516, filed Feb. 18, 1997 having inventors André Geis and Thomas Kraft and titled "Device for Cleaning Outer Cylindrical Surfaces of Cylinders in a Rotary Printing Machine" with Attorney Docket No. NHL-HBD-144 and claiming priority from Federal Republic of Germany Patent Application No. 196 05 957.7 filed on Feb. 27, 1996, and Ser. No. 08,822,590, filed concurrently or substantially concurrently with the present application having inventors Willi Becker, Jens Friedrichs and Frank Kropp (the inventors herein) and titled "Cleaning Device Provided on a Rotary Printing Machine" with Attorney Docket No. NHL-HBD-145 and claiming priority from Federal Republic of Germany Patent Application No. 196 11 126.9 filed on Mar. 21, 1996.

Other examples of cleaning devices for printing presses which may be utilized in accordance with the present invention can be found in the following U.S. Pat. Nos. 4,344,361, 4,651,644, 4,922,821, 4,981,078, 4,991,507, 5,105,740, 5,150,650 and 5,537,924.

Examples of valves that could be used or could be adapted for use with pneumatic cylinders in accordance with the present invention, as well as components generally used with valves could be disclosed in the following U.S. Pat. Nos. 5,520,217, 5,227,868, 4,995,424, 4,567,914 and 4,526,201.

Examples of registration or gripping devices for clamping or gripping foils and printing plates to plate cylinders or impression cylinders of printing presses that could be used in accordance with the present invention could be found in the following U.S. Patents, each of which are assigned to the assignee of the present invention: U.S. Pat. Nos. 4,831,931, 5,014,619, 5,076,165, 5,088,409, 5,249,522, 5,272,978, 5,440,984, 5,473,983 and 5,488,904.

Additional examples of registration or gripping devices for clamping or gripping foils and printing plates to plate cylinders or impression cylinders of printing presses that could be used in accordance with the present invention could be found in the following U.S. Pat. Nos. 5,596,928, 5,503,072, 5,495,804, 5,461,980, 4,831,931 and 4,831,931.

Examples of measurement devices for the determination of a rotary angle of a shaft, which measurement devices could be adapted for use in the context of the present invention, can be found in the following U.S. Pat. Nos. 5,473,237, 5,444,370, 5,444,369, 5,430,372, 5,428,290 and 5,424,535.

Other examples of pneumatic circuits, pneumatic systems, control circuits, and control systems adaptable for use in the context of the present invention, as well as commonly accepted pneumatic circuitry, pneumatic components and control circuitry symbols can be found in the following publications: *Design of Automatic Machinery,* copyright 1985 and authored by Kendrick W. Lentz, Jr., published by Van Nostrand Reinhold Company Inc. and having ISBN number 0-442-26032-6 and Library of Congress Catalog Card Number 84-3513; and *Pneumatics and Hydraulics,* fourth edition, copyright 1984, authored by Harry L. Stewart and revised by Tom Philbin, published by the Bobbs-Merrill Company, Inc. and having ISBN Number 0-672-23412-2.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 196 11 125.9, filed on Mar. 21, 1996, having inventors Willi Becker, Jens Friedrichs, and Frank Kropp, and DE-OS 196 11 125.9 and DE-PS 196 11 125.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A cleaning device for a rotary printing machine for cleaning the outer surface of a cylinder, said cleaning device comprising:

an arrangement to provide a cleaning cloth to clean the outer surface of a cylinder;

a profile being disposed along a substantial portion of the width of the outer surface of a cylinder to be cleaned to guide a cleaning cloth and to press a cleaning cloth on the outer surface of a cylinder to be cleaned;

said profile comprising an elastic material;

an arrangement to bias said profile against the outer surface of a cylinder to be cleaned;

a connector;

said connector being flexible;

said flexible connector being disposed between said profile and said biasing arrangement to provide a multipoint connection between said profile and said biasing arrangement to transfer force from said biasing arrangement to said profile; and said flexible connector comprises a spring bar being disposed to transfer force substantially uniformly to said profile and to substantially compensate for uneven areas across the width of the outer surface of the cylinder to be cleaned to substantially maintain contact between a cleaning cloth and the outer surface of the cylinder to be cleaned despite uneven areas in the outer surface of the cylinder to be cleaned.

2. The cleaning device according to claim 1 wherein said spring bar comprises a steel band.

3. The cleaning device according to claim 2 wherein said biasing arrangement comprises a spring arrangement.

4. The cleaning device according to claim 3 comprising a press-on bar, said press-on bar being disposed to support said spring arrangement and to press a cleaning cloth onto the outer surface of the cylinder to be cleaned.

5. The cleaning device according to claim 4 comprising at least one adjusting element, said at least one adjusting element being disposed to engage said press-on bar.

6. The cleaning device according to claim 5 wherein said at least one adjusting element comprises at least one pneumatic cylinder to engage said press-on bar.

7. The cleaning device according to claim 6 wherein said spring arrangement comprises:

at least one spring bolt; and at least one compression spring disposed about said at least one spring bolt.

8. The cleaning device according to claim 7 wherein:

said spring arrangement comprises at least one adjusting structure; and said at least one adjusting structure is configured and disposed to adjust said at least one compression spring.

9. The cleaning device according to claim 8 wherein said at least one adjusting structure comprises at least one adjusting nut.

10. The cleaning device according to claim 9 wherein said profile is mounted on said steel band.

11. The cleaning device according to claim 10 wherein said profile is removable from said steel band.

12. The cleaning device according to claim 11 wherein said at least one compression spring is fastened to said steel band.

* * * * *